US009785112B2

(12) United States Patent
Suzuki

(10) Patent No.: US 9,785,112 B2
(45) Date of Patent: Oct. 10, 2017

(54) IMAGE FORMING APPARATUS AND METHOD FOR CONTROLLING AN IMAGE FORMING APPARATUS

(71) Applicant: Brother Kogyo Kabushiki Kaisha, Nagoya-shi, Aichi-ken (JP)

(72) Inventor: Satoru Suzuki, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/223,059

(22) Filed: Jul. 29, 2016

(65) Prior Publication Data

US 2017/0031315 A1 Feb. 2, 2017

(30) Foreign Application Priority Data

Jul. 31, 2015 (JP) ..... 2015-151782

(51) Int. Cl.

| | |
|---|---|
| ***G03G 15/00*** | (2006.01) |
| ***G03G 21/20*** | (2006.01) |
| *G03G 15/06* | (2006.01) |
| *G03G 15/02* | (2006.01) |

(52) U.S. Cl.

CPC ..... *G03G 21/203* (2013.01); *G03G 15/50* (2013.01); *G03G 15/0266* (2013.01); *G03G 15/065* (2013.01); *G03G 15/5008* (2013.01)

(58) Field of Classification Search

CPC ..... G03G 21/203

See application file for complete search history.

(56) References Cited

U.S. PATENT DOCUMENTS

| | | | | |
|---|---|---|---|---|
| 8,655,229 | B2 | 2/2014 | Aratachi et al. | |
| 2008/0285985 | A1* | 11/2008 | Park | G03G 15/0822 399/27 |
| 2010/0247120 | A1* | 9/2010 | Murata | G03G 21/203 399/43 |
| 2011/0222878 | A1* | 9/2011 | Ochi | G03G 15/0806 399/44 |
| 2012/0243908 | A1 | 9/2012 | Aratachi et al. | |
| 2016/0320733 | A1* | 11/2016 | Kubo | G03G 15/065 |

FOREIGN PATENT DOCUMENTS

| | | | |
|---|---|---|---|
| JP | 2000-098734 | A | 4/2000 |
| JP | 2007-065581 | A | 3/2007 |
| JP | 2012-203010 | A | 10/2012 |
| JP | 2013-061419 | A | 4/2013 |

* cited by examiner

*Primary Examiner* — Ryan Walsh
(74) *Attorney, Agent, or Firm* — Banner & Witcoff, Ltd.

(57) ABSTRACT

An image forming apparatus, laving a photosensitive member, an exposure device to form an electrostatic latent image on the photosensitive member, a developer roller to supply a developer agent to the photosensitive member, a humidity sensor to detect humidity, and a controller, is provided. The controller executes a preparatory rotation controlling process, in which the photosensitive member and the developer roller are rotated prior to forming the electrostatic latent image, and an image-forming controlling process, in which the electrostatic latent image is formed on the photosensitive member. In the preparatory rotation controlling process, the developer roller is rotated at a first peripheral velocity under a condition of the humidity being lower than or equal to a predetermined value, and at a second peripheral velocity being higher than the first peripheral velocity under a condition of the humidity being higher than the predetermined value.

18 Claims, 11 Drawing Sheets

IMAGE FORMING APPARATUS AND METHOD FOR CONTROLLING AN IMAGE FORMING APPARATUS

CROSS-REFERENCE TO RELATED APPLICATION

This application claims priority under 35 U.S.C. §119 from Japanese Patent Application No. 2015-151782, filed on Jul. 31, 2015. The entire subject matter of the application is incorporated herein by reference.

BACKGROUND

Technical Field

The following description is related to an aspect of an image forming apparatus having a controller, which may control rotating velocity of a developer roller to supply an developer agent to a photosensitive member. The following description is further related an aspect of a controlling method for controlling the image forming apparatus by the controller.

Related Art

An image forming apparatus, in which a photosensitive member and a developer roller are arranged to contact each other, is known. The image forming apparatus may have a controller, which controls rotating velocities of the developer roller depending on operating conditions of the image forming apparatus, in order to restrain deterioration of a developer agent that may be held between the photosensitive member and the developer roller. For example, the rotating velocity of the developer roller when no image is being formed may be controlled to be lower than a rotating velocity of the developer roller when an image is being formed.

SUMMARY

In the known image forming apparatus, however, during preparatory rotation, in which the developer roller may be rotated prior to forming an image, if the rotating velocity of the developer roller is low, electric charge in the developer agent may be removed while the developer agent is being carried on the developer roller, and an amount of the charge in the developer agent may be lowered. As a result, the developer agent with the lowered charge amount may tend to adhere to unexposed areas, which should be kept off from the developer agent, in the photosensitive member. It is recognized that the developer agent may tend to adhere to the unexposed areas when humidity is higher.

The present disclosure is advantageous in that an image forming apparatus and a controlling method, by which adherence of a developer agent to unexposed areas in a photosensitive member may be restrained during preparatory rotation in higher humidity, are provided.

According to an aspect of the present disclosure, an image forming apparatus, including a photosensitive member, an exposure device configured to expose the photosensitive member and form an electrostatic latent image on the photosensitive member, a developer roller configured to contact the photosensitive member and supply a developer agent to the photosensitive member, a humidity sensor configured to detect humidity, and a controller configured to execute a preparatory rotation controlling process, in which the photosensitive member and the developer roller are rotated prior to forming the electrostatic latent image on the photosensitive member; and an image-forming controlling process, in which the electrostatic latent image is formed on the photosensitive member, is provided. In the preparatory rotation controlling process, the controller controls the developer roller to rotate at a first peripheral velocity under a condition of the humidity being lower than or equal to a predetermined value, and the controller controls the developer roller to rotate at a second peripheral velocity being higher than the first peripheral velocity under a condition of the humidity being higher than the predetermined value.

According to another aspect of the present disclosure, an image forming apparatus, including a photosensitive member, an exposure device configured to expose the photosensitive member and form an electrostatic latent image on the photosensitive member, a developer roller configured to contact the photosensitive member and supply a developer agent to the photosensitive member, a humidity sensor configured to detect humidity, a temperature sensor configured to detect temperature, and a controller configured to execute a preparatory rotation controlling process, in which the photosensitive member and the developer roller are rotated prior to forming the electrostatic latent image on the photosensitive member; and an image-forming controlling process, in which the electrostatic latent image is formed on the photosensitive member, is provided. In the preparatory rotation controlling process, the controller controls the developer roller to rotate at a first peripheral velocity under a condition of the humidity at a predetermined value of temperature being lower than or equal to a predetermined value of humidity, and the controller controls the developer roller to rotate at a second peripheral velocity being higher than the first peripheral velocity under a condition of the humidity at the predetermined value of temperature being higher than the predetermined value of humidity.

According to another aspect of the present disclosure, a method to control an image forming apparatus, which includes a photosensitive member, an exposure device configured to expose the photosensitive member and form an electrostatic latent image on the photosensitive member, and a developer roller configured to contact the photosensitive member and supply a developer agent to the photosensitive member, is provided. The method includes controlling preparatory rotation of the photosensitive member and the developer roller, in which the photosensitive member and the developer roller are controlled to rotate prior to forming the electrostatic latent image on the photosensitive member; and controlling image-forming, in which the electrostatic latent image is formed on the photosensitive member. During the control of the preparatory rotation, the developer roller is controlled to rotate at a first peripheral velocity under a condition of the humidity being lower than or equal to a predetermined value, and the developer roller is controlled to be rotated at a second peripheral velocity being higher than the first peripheral velocity under a condition of the humidity being higher than the predetermined value.

BRIEF DESCRIPTION OF THE ACCOMPANYING DRAWINGS

DETAILED DESCRIPTION

Figure 1:
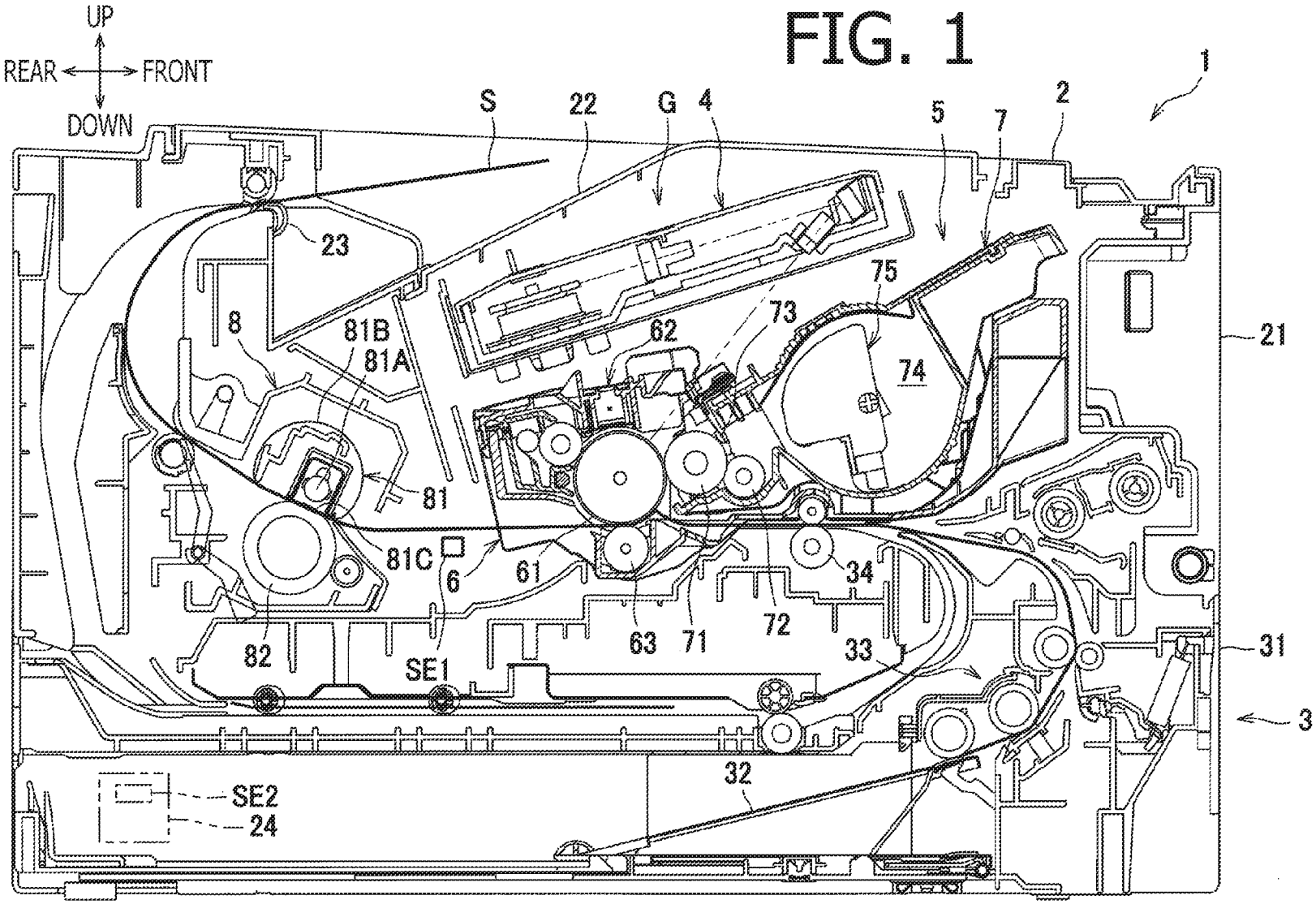
FIG. 1 is an illustrative cross-sectional side view of a laser printer according to an exemplary embodiment of the present disclosure.
Figure 2:
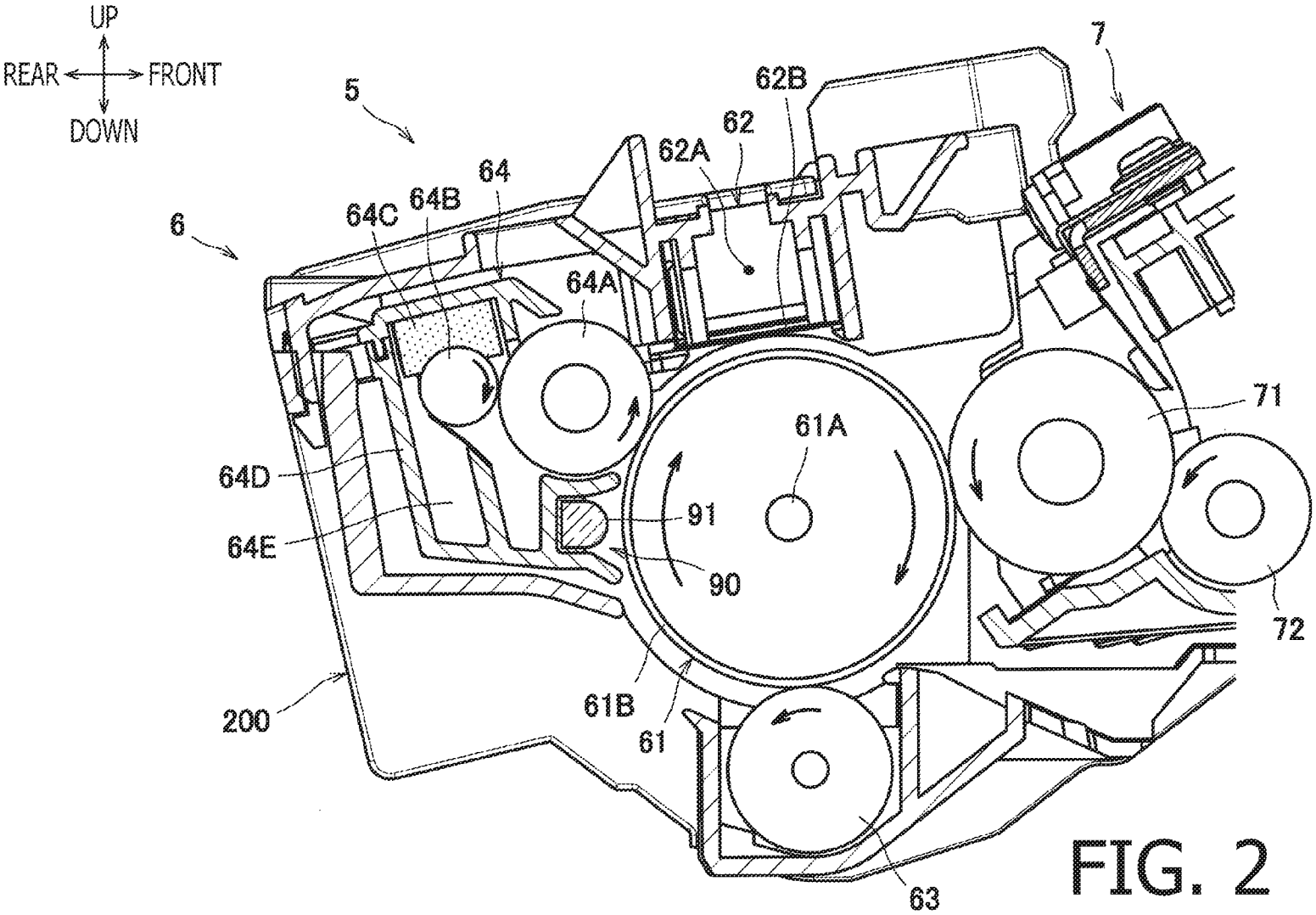
FIG. 2 is a cross-sectional view of a rear part of a processor cartridge in the laser printer according to the exemplary embodiment of the present disclosure.
Figure 3:
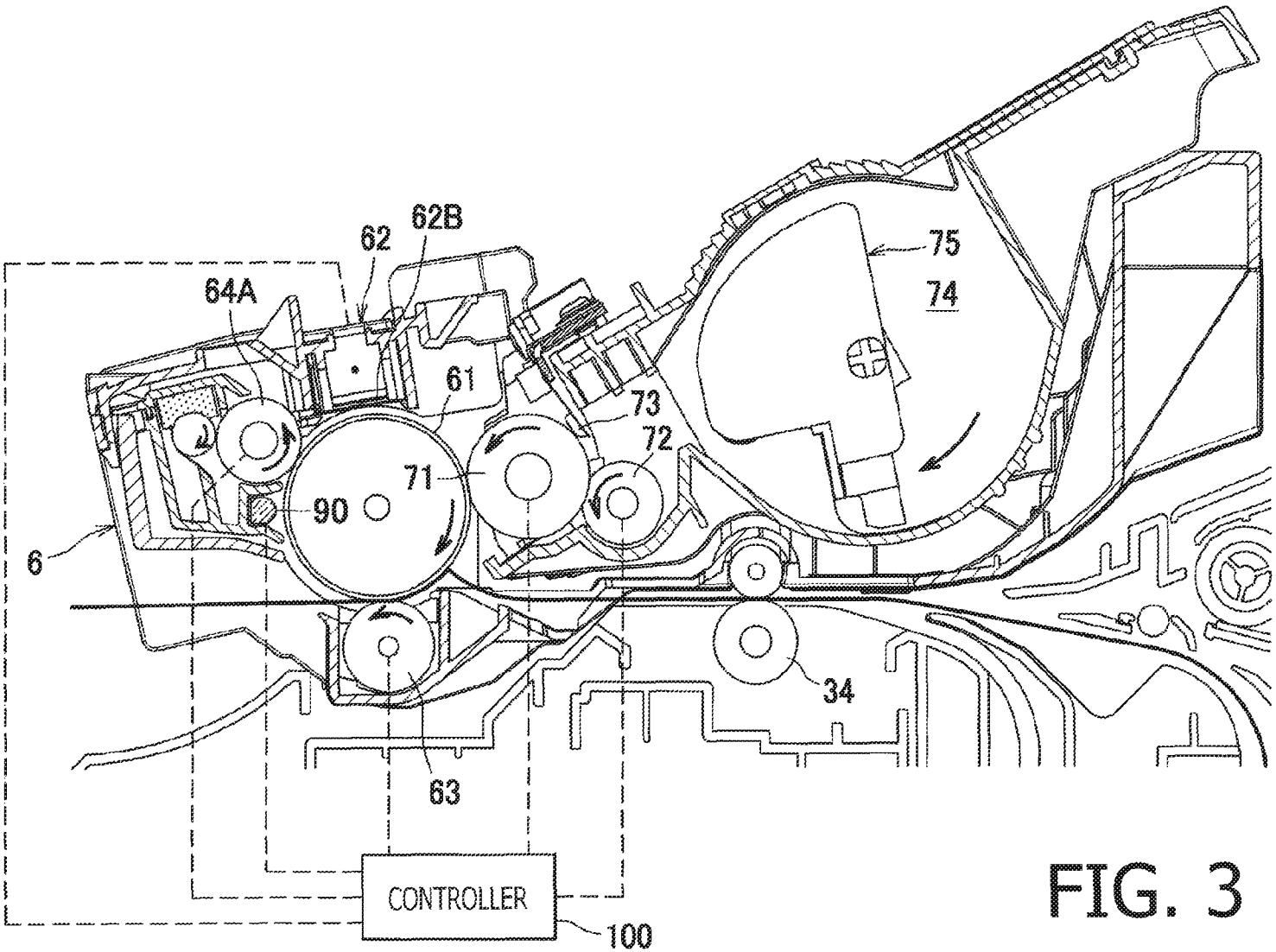
FIG. 3 is an illustrative view of a controller and devices, to which voltages controlled by the controller are applied, in the laser printer according to the exemplary embodiment of the present disclosure.
Figure 4:
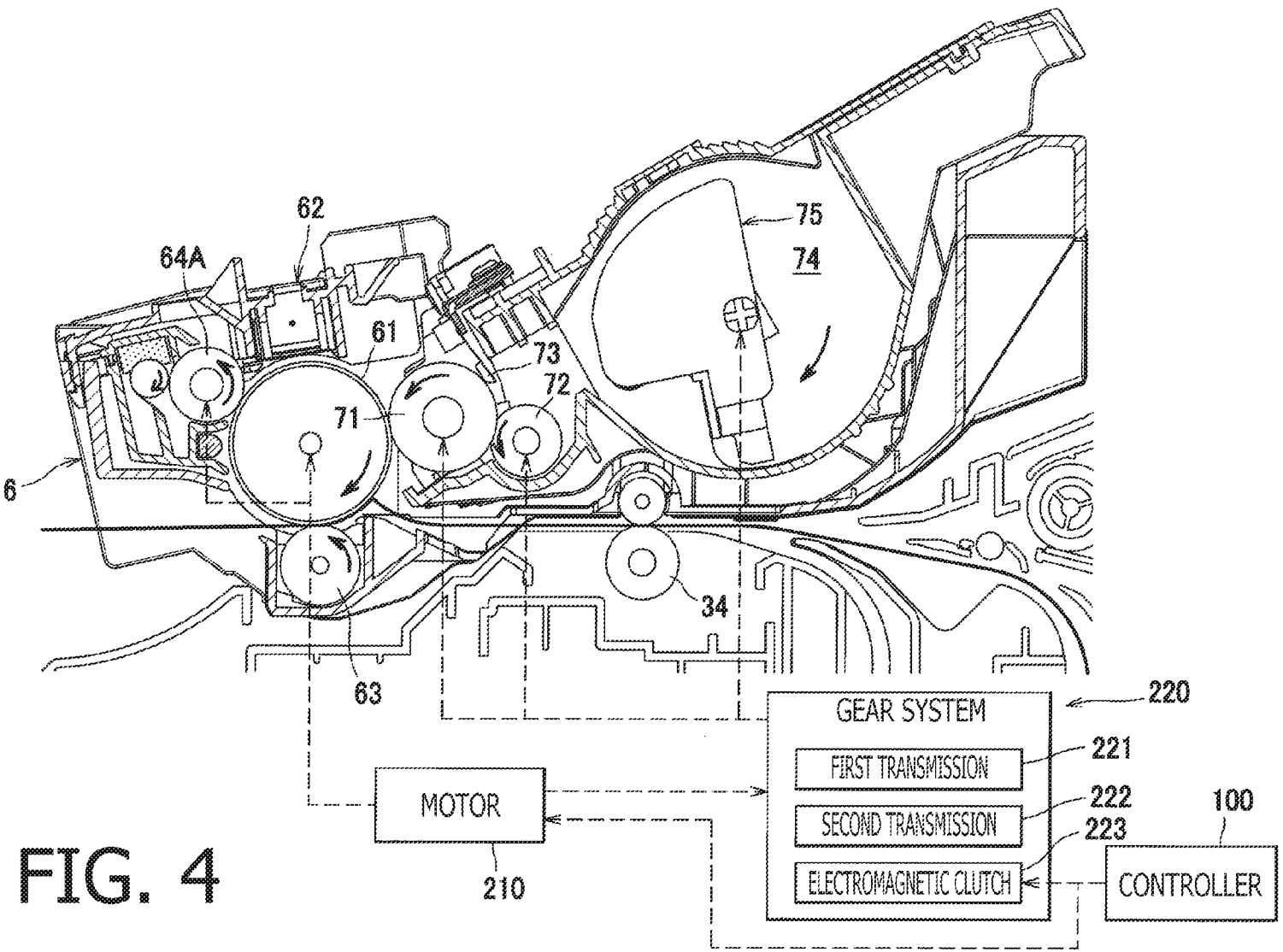
FIG. 4 is an illustrative view of connection of the devices in the processor cartridge with a motor, a gear system, and the controller in the laser printer according to the exemplary embodiment of the present disclosure.

Hereinafter, an exemplary configuration of a laser printer 1 being mage funning apparatus according to an embodiment of the present disclosure will be described with reference to the accompanying drawings. In the following description, directions concerning the laser printer 1 will be referred to in accordance with a user's ordinary position to use the laser printer 1 as indicated by arrows in FIGS. 1 and 2. For example, a viewer's right-hand side appearing in FIG. 1 is referred to as a front side of the laser printer 1, and a left-hand side in FIG. 1 opposite from the front side is referred to as a rear side. A side which corresponds to the viewer's nearer side is referred to as a left-hand side for the user, and an opposite side from the right, which corresponds to the viewer's farther side is referred to as a right-hand side for the user. An up-down direction in FIG. 1 corresponds to a vertical direction of the laser printer 1. A front-to-rear or rear-to-front direction may be referred to as a front-rear direction. Further, directions of the drawings in FIGS. 2-4 are similarly based on the orientation of the laser printer 1 as defined above and correspond to those with respect to the laser printer 1 shown in FIG. 1.

As shown in FIG. 1, the laser printer 1 includes a main body 2, an image forming unit G to form an image on a sheet S, and a sheet feeder 3 to feed the sheet S to the image forming unit G.

The sheet feeder 3 is disposed in a lower position in the main body 2 and includes a feeder tray 31, a sheet-pressing plate 32, a feeder device 33, and a registration roller 34. In the sheet feeder 3, the sheets S set in the feeder tray 31 are lifted upward by the sheet-pressing plate 32 and fed one-by-one by the feeder device 33 to the image forming unit G.

The image forming unit G includes an exposure device 4, a processor cartridge 5, and a fixing device 8.

The exposure device 4 is disposed in an upper position in the main body 2 and includes a laser emitter (not shown), polygon mirrors, lenses, and reflection mirrors, which may be shown but unsigned. In the exposure device 4, a laser beam, indicated in double-dotted line in FIG. 1, is emitted at a surface of a photosensitive drum 61 in the processor cartridge 5 via the polygon mirrors, the lenses, and the reflection mirrors so that the surface of the photosensitive drum 61 is selectively exposed to the laser beam.

The processor cartridge 5 is disposed in a lower position with respect to the exposure device 4. The processor cartridge 5 is detachably attached to the main body 2 through an opening, which may be exposed when a front cover 21 of the main body 2 is open. The processor cartridge 5 includes a drum unit 6 and a developer unit 7. The drum unit 6 includes the photosensitive drum 61, a scorotron charger 62, and a transfer roller 63. The developer unit 7 includes a developer roller 71, a supplier roller 72, and a toner-spreader blade 73, a toner container 74 to contain positively-chargeable toner being a developer agent, and an agitator 75 to rotate in the toner container 74.

In the processor cartridge 5, as the photosensitive drum 61 rotates, a surface of the photosensitive drum 61 is electrically evenly charged by the charger 62 and partly exposed to the laser beam emitted from the exposure device 4 so that the areas exposed to the laser beam form an electrostatic latent image according to image data, and the electrostatic latent image is carried on the surface of the photosensitive drum 61. Meanwhile, in areas that are not exposed to the laser beam, no electrostatic latent image is formed. The agitator 75 rotates in the toner container 74 to stir the toner and conveys the stirred toner toward the developer roller 71. The supplier roller 72 arranged to contact the developer roller 71 rotates along with the developer roller 71 and supplies the toner discharged out of the toner container 71 by the agitator 75 to the developer roller 71. The developer roller 71 is arranged to contact the toner-spreader blade 73, and as the developer roller 71 rotates, the toner-spreader blade 73 flattens the toner evenly on a surface of the developer roller 71 so that the toner is carried on the surface of the developer roller 71 in a layer.

Thereafter, in the developer unit 7, the toner carried on the developer roller 71 is supplied to the electrostatic latent image on the photosensitive drum 61 to visualize the electrostatic latent image and develop a toner image on the photosensitive drum 61. The sheet S fed by the sheet feeder 3 is carried to a position between the photosensitive drum 61 and the transfer roller 63 so that the toner image on the photosensitive drum 61 is transferred onto the sheet S. Meanwhile, the unexposed areas in the photosensitive drum 61, in which no electrostatic latent image was funned, may be kept from adherence of the toner.

The fixing device 8 is disposed in a rearward position with respect to the processor cartridge 5 and includes a heating unit 81 and a pressure roller 82. The heating unit 81 includes a halogen heater 81A, a fuser belt 81B, and a nipper board 81C. The pressure roller 82 is arranged to nip the fuser belt 81B in conjunction with the nipper board 81C of the heating unit 81. The fixing device 8 conveys the sheet S, onto which the toner image is transferred, through the position between the heating unit 81 and the pressure roller 82 so that the toner image on the sheet S is fused and fixed thereon. The sheet S with the toner image fixed thereon is conveyed by an ejection roller 23 to be ejected out of the main body 2 and placed on an ejection tray 22.

As shown in FIG. 2, the processor cartridge 5, in particular the drum unit 6 in the processor cartridge 5, includes a cleaning unit 64, a neutralizing lamp 90, a drum frame 200, further to the photosensitive drum 61, the charger 62, and the transfer roller 63. The charger 62 may include a charging wire 62A and a grid electrode 62B, which is arranged in a position between the charging wire 62A and the photosensitive drum 61.

The photosensitive drum 61 includes a drum body 61B, which is conductive and formed in a cylindrical shape, a photosensitive layer (unsigned) on an outer circumference of the drum body 61B and a shaft 61A, which is conductive with the drum body 61B and is grounded. Meanwhile, the charger 62 is arranged in an upper position with respect to the photosensitive drum 61 to face the photosensitive drum 61, and the transfer roller 63 is arranged in a lower position with respect to the photosensitive drum 61 to contact the photosensitive drum 61. The developer roller 71 in the developer unit 7 is arranged to contact the photosensitive drum 61 at a position downstream from a position, where the photosensitive drum 61 and the charger 62 face each other, and upstream from a position, where the photosensitive drum 61 and the transfer roller 63 face each other, with regard to a rotating direction of the photosensitive drum 61 indicated by arrows in FIG. 2. A rotating direction of the developer roller 71 is, as indicated by an arrow in FIG. 2, a direction, in which a portion of a circumferential surface of the developer roller 71 that contacts the photosensitive drum 61 moves in the same direction as the photosensitive drum 61. In this regard, the rotating directions of the photosensitive drum 61 and the developer roller 71 are opposite to each other. Meanwhile, the supplier roller 72 is arranged to contact the photosensitive drum 61 on a side opposite from the developer roller 71 across the photosensitive drum 61.

The cleaning unit 64 collects residues including residual toner and dust from the outer circumference of the photosensitive drum 61 after the transfer of the toner image from the photosensitive drum 61 to the sheet S. The cleaning unit 64 includes a cleaning roller 64A, a collecting roller 64B, a scraper 64C, and a cleaner frame 64D to support the cleaning roller 64A and the other members. The cleaning roller 64A is arranged downstream from the position, where the photosensitive drum 61 and the transfer roller 63 face each other, and upstream from the position, where the photosensitive drum 61 and the charger 62 face each other, with regard to the rotating direction indicated by arrows in FIG. 2 and in a substantially proximate position to collect the residues from the photosensitive drum 61.

The cleaning unit 64 removes the residues from the photosensitive drum 61 by the cleaning roller 64A and collects the residues adhered to the cleaning roller 64A by the collecting roller 64B. Further, the residues adhered to the collecting roller 64B are scraped off from the collecting roller 64B by the scraper 64C and stored in a residue container 64E, which is formed in the cleaner frame 64D.

The neutralizing lamp 90 includes an emitter 91, which is arranged to face the surface of the photosensitive drum 61, to emit light onto the surface of the photosensitive drum 61 to reduce electric charges remaining on the surface of the photosensitive drum 61 after the image transfer. The emitter 91 of the neutralizing lamp 90 is arranged upstream from the position, where the photosensitive drum 61 and the transfer roller 63 face each other, and upstream from the position, where the photosensitive drum 61 and the cleaning roller 64A face each other, with regard to the rotating direction of the photosensitive drum 61, to face the photosensitive drum 61.

The drum frame 200 being a frame in the drum unit 6 supports the photosensitive drum 61 and the transfer roller 63 rotatably and the cleaning unit 64. Further, the drum frame 200 may support the developer unit 7, which may be detachably attached to the drum frame 200.

As shown in FIG. 1, in the main body 2, arranged are an interior temperature sensor SE1, a humidity sensor SE2, and a controller 100 (see FIG. 3).

The interior temperature sensor SE1 detects a temperature in the main body 2 and may be, for example, a thermistor. The interior temperature sensor SE1 is arranged in the main body 2 in a position between the fixing device 8 and the processor cartridge 5 with regard to the front-rear direction. Thus, the interior temperature sensor SE1 is disposed in the main body 2, outside the processer cartridge 5.

The humidity sensor SE2 may be, for example, a sensor to detect relative humidity, and is arranged on an inner side with respect to an inlet port 24, which is formed in the main body 2. The humidity sensor SE2 may be arranged in a position, for example, to coincide with the inlet port 24. In other words, the humidity sensor SE2 may be exposed to the air entering the main body 2 through the inlet port 24. The humidity sensor SE2 may detect humidity of the air entering through the inlet port 24 so that the humidity of the air outside the main body 2 may be measured and determined. The temperature detected by the interior temperature sensor SE1 and the humidity detected by the humidity sensor SE2 are output to the controller 100.

The controller 100 includes a central processing unit (CPU), a random access memory (RAM), a read-only memory ROM), and input/output circuits, which are not shown. The controller 100 may apply voltages to electrical devices in the laser printer 1 including the charger 62, the developer roller 71, the supplier roller 72, the cleaning roller 64A, and the neutralizing lamp 90. Further, the controller 100 may control behaviors of a motor 210 and a gear system 220 (see FIG. 4), which are disposed in the main body 2.

The motor 210 is a source to provide driving force to the electrical devices including the photosensitive drum 61, the developer roller 71, the supplier roller 72, the agitator 75, and the cleaning roller 64A. The motor 210 is controlled by the controller 100 to rotate at a first rotating velocity and a second rotating velocity, which is higher than the first rotating velocity. The motor 210 is coupled with the photosensitive drum 61 at a fixed gear ratio; therefore, when the motor 210 rotates at the fist rotating velocity, the photosensitive drum 61 rotates at a first drum peripheral velocity corresponding to the first rotating velocity. When the motor 210 rotates at the second rotating velocity, the photosensitive drum 61 rotates at a second drum peripheral velocity, which corresponds to the second rotating velocity and is higher than the first drum peripheral velocity. In the following description, the first rotating velocity and the first drum peripheral velocity may be called as a low velocity, and the second rotating velocity and the second drum peripheral velocity may be called as a high velocity.

The motor 210 is coupled to the photosensitive drum 61 and the cleaning roller 64A through predetermined numbers of gears and to the developer roller 71, the supplier roller 72, and the agitator 75 through the gear system 220, which may change rotating velocities of developer roller 71, the supplier roller 72, and the agitator 75. In particular, the developer roller 71, the supplier roller 72, and the agitator 75 are coupled to one another through a predetermined number of gears so that the developer roller 71, the supplier roller 72, and the agitator 75 may rotate in synchronization at a predetermined peripheral velocity ratio.

The gear system 220 is configured to switch gear ratios between the motor 210 and the developer roller 71. The gear system 220 may switch a peripheral velocity V of the developer roller 71 between a first roller peripheral velocity V1 and a second roller peripheral velocity V2 being lower than the first roller peripheral velocity V1. The first roller peripheral velocity V1 is set to have a value greater than zero (0). Switching the peripheral velocities V of the developer roller 71 through the gear system 220 may switch a peripheral velocity ratio of the developer roller 71 with respect to the photosensitive drum 61. In the present embodiment, the second roller peripheral velocity V2 is set to have a value greater than a value of the peripheral velocity of the photosensitive drum 61, and the first roller peripheral velocity V1 is set to have a value smaller than the value of the peripheral velocity of the photosensitive drum 61. Therefore, when the peripheral velocity V of the developer roller 71 is at the first roller peripheral velocity V1, the peripheral velocity ratio of the developer roller 71 with respect to the photosensitive drum 61 is lower than one (1); and when the peripheral velocity V of the developer roller 71 is at the second roller peripheral velocity V2, the peripheral velocity ratio of the developer roller 71 with respect to the photosensitive drum 61 is greater than or equal to one (1).

The gear system 220 may include a first transmission 221, a second transmission 222, and an electromagnetic clutch 223. The first transmission 221 may transmit the driving force from the motor 210 to the developer roller 71 at a first gear ratio to rotate the developer roller 71 at the second roller peripheral velocity V2. The second transmission 222 may transmit the driving force from the motor 210 to the developer roller 71 at a second gear ratio to rotate the developer roller 71 at the first roller peripheral velocity V1. The electromagnetic clutch 223 may switch transmission paths for the driving three from the motor 210 to the developer roller 71 between the first transmission 221 and the second transmission 222. In the gear system 220, when the electromagnetic clutch 223 is switched off, the driving force from the motor 210 may be transmitted to the developer roller 71 through the second transmission 2 when the electromagnetic clutch 223 is switched on, the driving force from the motor 210 may be transmitted to the developer roller 71 through the first transmission 221.

The controller 100 may control a preparatory rotation controlling process, in which the photosensitive drum 61 and the developer roller 71 are rotated prior to forming the electrostatic latent image on the photosensitive drum 61; an image-forming controlling process, in which the electrostatic latent image is formed on the photosensitive drum 61; and a velocity-reduction controlling process, in which rotations of the photosensitive drum 61 and the developer roller 71 are slowed to stop. In order to apply a voltage to the charger 62, the controller 100 applies a wire-voltage Vw to the charging wire 62A in the charger 62 so that a positive grid-voltage Vg is applied to the grid electrode 62B. Further, in order to apply a voltage to the developer roller 71, the controller 100 applies a homopolar developer-voltage Vb, which is a positive voltage lower than the grid-voltage Vg, to the developer roller 71.

The controller 100 may execute the preparatory rotation controlling process upon entry of a print command, which is a command to activate a printing operation. In the preparatory rotation controlling process, the controller 100 may control the motor 210 to rotate at the low velocity and switch the electromagnetic clutch 223 on or off, according to values (e.g., degree and percentage) of the temperature and the humidity detected by the interior temperature sensor SE1 and the humidity sensor SE2, to switch the peripheral velocities of the developer roller 71.

For example, in the preparatory rotation controlling process, the controller 100 may control the developer roller 71 to rotate at the first roller peripheral velocity V1 by switching the electromagnetic clutch 223 off when the humidity at a predetermined value of temperature is at a predetermined value or lower. Further, in the preparatory rotation controlling process, the controller 100 may switch the electromaguetic clutch 223 on to rotate the developer roller 71 at the second roller peripheral velocity V2, which is higher than the first roller peripheral velocity V1, when the humidity at a predetermined value of temperature is higher than a predetermined value of humidity. In the following description, an environmental condition, in which the humidity at a predetermined value of temperature is higher than a predetermined value of humidity, will be referred to as high humidity, and an environmental condition, in which the humidity at the predetermined value of temperature is at the predetermined value of humidity or lower, will be referred to as low humidity.

Figure 5:
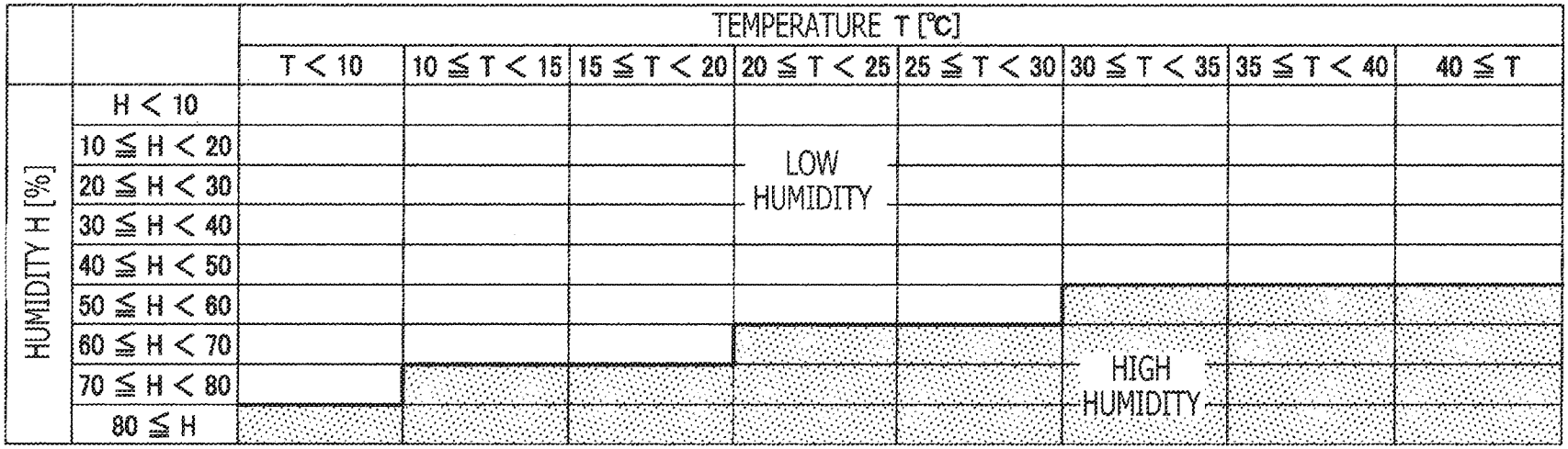
FIG. 5 is an environment reference table to be referred to by the controller in the laser printer according to the exemplary embodiment of the present disclosure.

The controller 100 may determine the environmental condition between the high humidity and the low humidity with reference to a environment reference table shown in FIG. 5. When the controller 100 determines that the humidity is not high, or low, the controller 71 may control the developer roller 71 to rotate at the first roller peripheral velocity V1. When the controller 100 determines that the humidity is high, the controller 71 may control the developer roller 71 to rotate at the second roller peripheral velocity V2. For example, as long as the temperature is lower than 10 degrees C., when the humidity is lower than 80 percent, the controller 100 may determine that the humidity is low, and when the humidity is 80 percent or higher, the controller 100 may determine that the humidity is high.

For another example, as long as the temperature is 10 degrees C. or higher but lower than 20 degrees C., when the humidity is lower than 70 percent, the controller 10 may determine that the humidity is low; and when the humidity is 70 percent or higher, the controller 100 may determine that the humidity is high. Further, as long as the temperature is 20 degrees C. or higher but lower than 30 degrees C., when the humidity is lower than 60 percent, the controller 100 may determine that the humidity is low; and when the humidity is 60 percent or higher, the controller 100 may determine that the humidity is high.

In the preparatory rotation controlling process, as long as the temperature is 30 degrees C. or higher, when the humidity is lower than 50 percent, the controller 100 may determine that the humidity is low; and when the humidity is 50 percent or higher, the controller 100 may determine that the humidity is high. The environment reference table may be prepared in consideration of results of experiments and simulations to observe adhesiveness of the toner to the unexposed areas in the photosensitive drum 61 in relation with various factors including temperature, humidity, peripheral velocities of the developer roller 71, grid-voltages Vg, and developer-voltages Vb, which will be described later in detail. In the present embodiment, when the preparatory rotation controlling process is conducted with the developer roller 71 being rotated at the first roller peripheral velocity V1, a range of the temperature and humidity, in which the toner may be restrained from adhering to the unexposed areas in the photosensitive drum 61, is indicated by blank fields in FIG. 5. Meanwhile, a range of the temperature and humidity, in which the toner may tend to adhere to the unexposed areas in the photosensitive drum 61, is indicated by hatching in FIG. 5.

Further, in the preparatory rotation controlling process, the controller 100 may apply a first grid-voltage Vg1 to the grid electrode 62B and a first developer-voltage Vb1, which is lower than the first grid-voltage Vg1 to the developer roller 71.

The controller 100 may execute the image-forming controlling process after completion of the preparatory rotation controlling process. In the image-forming controlling process, the controller 100 may control the motor 210 to rotate at the high velocity and switch the electromagnetic clutch 223 on to rotate the photosensitive drum 61 at a higher rotating velocity than the rotating velocity of the photosensitive drum 61 during the preparatory rotation controlling process and rotate the developer roller 71 at a third roller peripheral velocity V3, which is higher than the second roller peripheral velocity V2. For example, upon starting the image-forming controlling process, the controller 100 may switch the motor 210 from the low velocity to the high velocity; switch the electromagnetic clutch 223 from off to on if the electromagnetic clutch 223 was off during the preparatory rotation controlling process; or maintain the electromagnetic clutch 223 on if the electromagnetic clutch 223 was on during the preparatory rotation controlling process. Thus, the electromagnetic clutch 223 is maintained on during the image-forming controlling process so that the peripheral velocity ratio of the developer roller 71 with respect to the photosensitive drum 61 should be greater than or equal to 1. In other words, the peripheral velocity of the developer roller 71 should be higher than the peripheral velocity of the photosensitive drum 61.

In the image-forming controlling process, further, the controller 100 may apply a second grid-voltage Vg2, which is higher than the first grid-voltage Vg1, to the grid electrode 62B and apply a second developer-voltage Vb2, which is higher than the first developer-voltage Vb1, to the developer roller 71. In this regard, the second developer-voltage Vb2 is lower than the second grid-voltage Vg2.

After completion of the image-forming controlling process, the controller 100 may start the velocity-reduction controlling process by stopping supplying power to the motor 210. In the velocity-reduction controlling process, the controller 100 switches the electromagnetic clutch 223 off to reduce the peripheral velocity ratio of the developer roller 71 with respect to the photosensitive drum 61 to a value lower than one (1). In other words, the peripheral velocity of the developer roller 71 is lowered compared to the peripheral velocity of the photosensitive drum 61.

In the velocity-reduction controlling process, further, the controller 100 may control the grid-voltage Vg and the developer-voltage Vb according to the temperature and the humidity detected by the interior temperature sensor SE1 and the humidity sensor SE2. Specifically, the controller 100 may conduct, as long as the humidity at the predetermined temperature is higher than the predetermined value, a first voltage controlling process, hi which the controller 100 applies the first grid-voltage Vg1 being lower than the second grid-voltage Vg2 to the grid electrode 62B and a third developer-voltage Vb3 being higher than the second developer-voltage Vb2 to the developer roller 71. The third developer voltage Vb3 is lower than the first grid-voltage Vb1. Meanwhile, when the humidity at the predetermined temperature is lower than or equal to the predetermined value, the controller 100 may conduct a second voltage controlling process, in which the controller 100 applies the first grid-voltage Vg1 to the grid electrode 62B and the first developer-voltage Vb1 being lower than the second developer-voltage Vb2 to the developer roller 71.

Thus, the controller 100 may determine the humidity between the high humidity and the low humidity with reference to the environment reference table shown in FIG. 5, and if the controller 100 determines that the humidity is not high but is low, the controller 100 may conduct the second voltage controlling process. On the other hand, if the controller 100 determines that the humidity is high, the controller 100 may conduct the first voltage controlling process. It may be noted that, in the present embodiment, the humidity may be determined with reference to the same environment reference table shown in FIG. 5 as the table referred to in the preparatory rotation controlling process; however, the humidity may not necessarily be determined with reference to the same environment reference table as the table referred to in the preparatory rotation controlling process. For example, a range of temperature and humidity in which the toner should be restrained from adhering to the unexposed areas in the photosensitive drum 61 when the second voltage controlling process is conducted in the velocity-reduction controlling process, may be defined as the low humidity.

Further, the controller 100 may stop applying the voltages to the charger 62 and the developer roller 71 in the velocity-reduction controlling process when the rotating velocity of the photosensitive drum 61 is reduced to be lower than or equal to a predetermined velocity, e.g., zero (0).

Furthermore, in the velocity-reduction controlling process, the controller 100 may control a transfer-voltage to be applied to the transfer roller 63, a cleaner-voltage to be applied to the cleaning roller 64A, and switching on and off of the neutralizing lamp 90.

Next, flows of steps in a method to control the voltages by the controller 100 will be described with reference to FIGS. 6 and 7.

Figure 6:
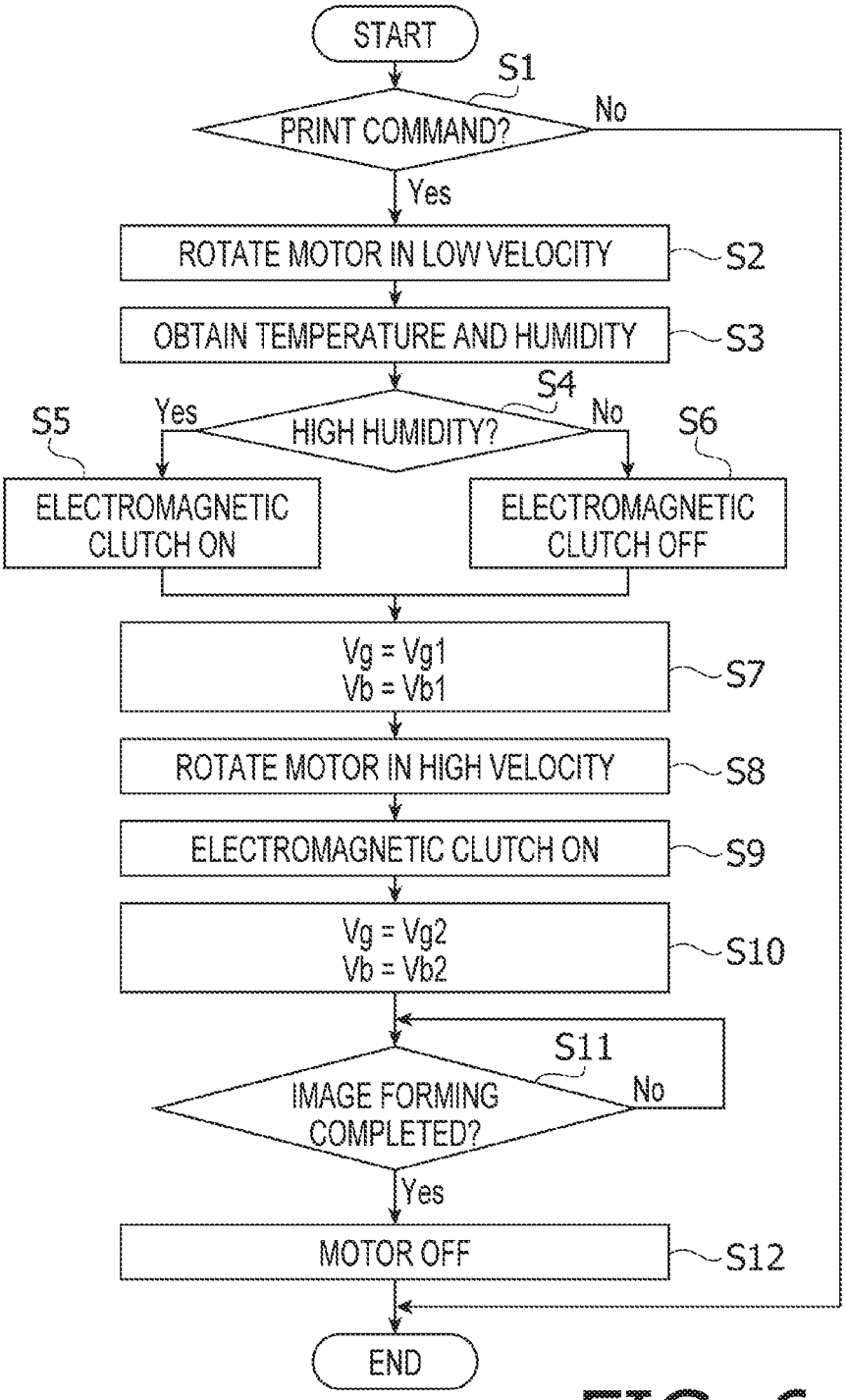
FIG. 6 is a flowchart, to illustrate a controlling flow in a preparatory rotation controlling process and an image-forming controlling process to be conducted by the controller in the laser printer according to the exemplary embodiment of the present disclosure.

As shown in FIG. 6, in S1, the controller 100 determines whether a print command, which is a command to activate a printing operation, is entered. When the controller 100 determines that the print command was entered (S1: YES), in S2, the controller 100 switches the motor 210 on and manipulates the motor 210 to rotate at the low velocity to start the preparatory rotation controlling process. For example, the controller 100 may supply a first current A1 to the motor 210 to rotate the motor 210 at the low velocity. Thereby, the photosensitive drum 61 and the developer roller 71 may be rotated at the first drum peripheral velocity and the first roller peripheral velocity V1, respectively.

Following S2, in S3 the controller 100 obtains a value of temperature and a value of humidity from the interior temperature sensor SE1 and the humidity sensor SE2, respectively. Thereafter, in S4, the controller 100 determines whether the humidity is high or low with reference to the temperature, the humidity, and the environment reference table shown in FIG. 5. For example, the controller 100 may determine whether the humidity is high or low by determining whether the value of humidity detected by the humidity sensor SE2 is higher or equal to a predetermined threshold value, which may vary depending on the value of temperature detected by the interior temperature sensor SE1.

If the controller 100 determines that the humidity is high in S4 (S4: YES), in S5, the controller 100 switches the electromagnetic clutch 223 on so that the peripheral velocity of the developer roller 71 is switched from the first roller peripheral velocity V1 to the second roller peripheral velocity V2. If the controller 100 determines that the humidity is not high but low in S4 (S4: NO), in S6, the controller 100 maintains the electromagnetic clutch 223 off so that the peripheral velocity of the developer roller 71 is maintained at the first roller peripheral velocity V1.

Following S5 or S6, in S7, the controller 100 applies the first grid-voltage Vg1 and the first developer-voltage Vb1 to the grid electrode 62B and the developer roller 71, respectively. The voltages Vg, Vb may be controlled to be switched in an order: the grid-voltage Vg earlier, and the developer-voltage Vb later for a predetermined length of time, so that the developer-voltage Vb should be changed when a part of the photosensitive drum 61, of which surface potential has been changed earlier by the change in the grid-voltage Vg, reaches the developer roller 71. The second grid-voltage Vg2 and the second developer-voltage Vb2, which will be described later in detail, should be applied in the similar order and timings.

After elapse of a predetermined length of time from 87, in S8, the controller 100 supplies a second current A2, which is more intense than the first current A1, so that the motor 210 rotates at the high velocity. The predetermined length of time may have a length, which is required for the preparatory rotation controlling process. In other words, the controller 100 determines in S8 that the preparatory rotation controlling process is completed based on the determination that the predetermined length of time elapsed and rotates the motor 210 at the high velocity to start the image-forming controlling process.

Following S8, in S9, the controller 100 switches the electromagnetic clutch 223 on. Specifically, when the electromagnetic clutch 223 is already on, the controller 100 may maintain the electromagnetic clutch 223 on; or when the electromagnetic clutch 223 is off, the controller 100 may switch the electromagnetic clutch 223 on.

Following S9, in S10, the controller 100 supplies the second grid-voltage Vg2, which is higher than the first grid-voltage Vg1, to the grid electrode 62B and the first developer-voltage Vb1, which is higher than the second developer-voltage Vb2, to the developer roller 71. Following S10, in S11, the controller 100 determines whether the image-forming controlling process is completed. Completion of the image-forming controlling process may be determined when, fir example, the images are determined to have been formed on a number of sheets S as commanded in the print command, and the number of sheets S are determined to have been ejected.

In S11, if the controller 100 determines that the image-forming controlling process is ongoing and incomplete (S11: NO), S11 is repeated. If the controller 100 determines that the image-forming controlling process is completed (S11: YES), in S12, the controller 100 stops supplying the power to the motor 210 so that the motor 210 is turned off. Following S12, or following negative determination in S1 (S1: NO), the controller 100 ends the flow.

In the meantime, the controller 100 activates the velocity-reduction controlling process by stopping the power supply to the motor 210 in S12. In the velocity-reduction controlling process, as shown in FIG. 7, in S21, the controller 100 determines whether the humidity is high or low with reference to the temperature, the humidity, and the environment reference table shown in FIG. 5.

If the controller 100 determines that the humidity is high in S21 (S21: YES), in S22, the controller 100 conducts the first voltage controlling process. Specifically, in S22, the controller 100 may apply the first grid-voltage Vg1, which is lower than the second grid-voltage Vg2, to the grid electrode 62B and the third developer-voltage Vb3, which is higher than the second developer-voltage Vb2, to the developer roller 71.

If the controller 100 determines that the humidity is not high but low in S21 (S21: NO), in S23, the controller 100 conducts the second voltage controlling process. Specifically, the controller 100 may apply the first grid-voltage Vg1 to the grid electrode 62B and the first developer-voltage Vb1, which is lower than the second developer-voltage Vb2, to the developer roller 71.

Following S22 or S23, in S24, the controller 100 determines whether the rotating velocity of the photosensitive drum 61 is reduced to a predetermined velocity or lower. The determination in S24 may be made, for example, based on output from a sensor that may detect the rotating velocity of the photosensitive drum 61 or based on an elapsed time period since the stop of the power supply to the motor 210.

In S24, if the controller 100 determines that the rotating velocity of the photosensitive drum 61 is higher than the predetermined velocity (S24: NO), the controller 100 repeats S24. If the controller 100 determines that the rotating velocity of the photosensitive drum 61 is lower than or equal to the predetermined velocity (S24: YES), in S25, the controller 100 stops applying the grid-voltage Vg to the grid electrode 62B and the developer-voltage Vb to the developer roller 71.

Next, behaviors of the controller 100 will be described chronologically with reference to a timing chart shown in FIG. 8.

Figure 8:
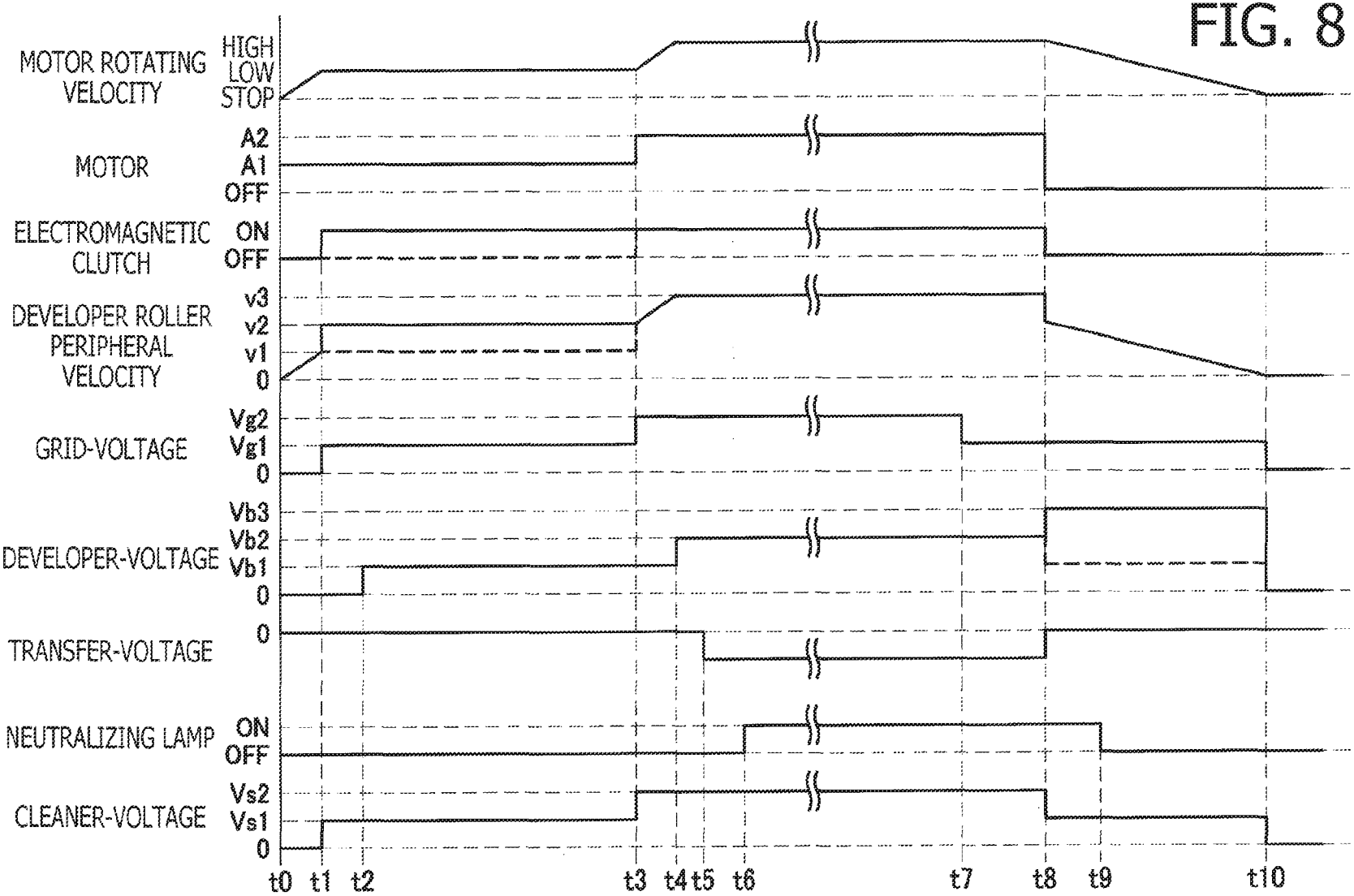
FIG. 8 is a time chart to illustrate behaviors of the controller when humidity is high and not high in the laser printer according to the exemplary embodiment of the present disclosure.

As shown in FIG. 8, when the controller 100 receives the print command at t0, the controller 100 supplies the first current A1 to the motor 210. Thereby, the rotating velocity of the motor 210 increases to the low velocity so that the peripheral velocity of the photosensitive drum 61 is increased to the low velocity, and the peripheral velocity of the developer roller 71 is increased to the first roller peripheral velocity V1. It may be noted that the peripheral velocity of the photosensitive drum 61 is in the proportional relation with the rotating velocity of the motor 210; therefore, in FIG. 8, while a graph to indicate the rotating velocity of the motor 210 is shown, a graph to indicate the peripheral velocity of the photosensitive drum 61 is omitted.

The controller 100 determines whether the humidity is high based on the temperature, the humidity, and the environment reference table. When the humidity is determined not to be high but low, the controller 100 maintains the electromagnetic clutch 223 off so that the developer roller 71 is rotated at the first roller peripheral velocity V1, as indicated by a broken line in FIG. 8. Meanwhile, when the humidity is determined to be high, the controller 100 switches the electromagnetic clutch 223 on so that the developer roller 71 is rotated at the second roller peripheral velocity V2, as indicated by a solid line in FIG. 8.

Further, after receiving the print command and starting rotating the motor 210, at t1, the controller 100 applies the first grid-voltage Vg1 to the grid electrode 62B and a first cleaner-voltage Vs1 to the cleaning roller 64A. After a predetermined length of time from the start of applying the first grid-voltage Vg1, at t2, the controller 100 applies the first developer-voltage Vb1 to the developer roller 71. The timing t2 is a moment when the surface of the photosensitive drum 61 that was charged at t1 should reach the position to contact the developer roller 71.

After completion of the preparatory rotation controlling process, at 13, the controller 100 switches the current to the motor 210 from the first current A1 to the second current A2 and switches the electromagnetic clutch 223 from off to on so that the image-forming controlling process starts. Thereby, the rotating velocity of the motor 210 and the peripheral velocity of the photosensitive drum 61 increase from the low velocity to the high velocity, and the peripheral velocity of the developer roller 71 is switched from the first roller peripheral velocity V1 to the second roller peripheral velocity V2, and thereafter increased gradually from the second roller peripheral velocity V2 to the third roller peripheral velocity V3.

At t3, the controller 100 switches the grid-voltage Vg to be applied to the grid electrode 62B from the first grid-voltage Vg1 to the second grid-voltage Vg2, which is higher than the first grid-voltage Vb1. Further, at t3, the controller 100 switches the cleaner-voltage to be applied to the cleaning roller 64A from the first cleaner-voltage Vs1 to a second cleaner voltage Vs2, which is higher than the first cleaner-voltage Vs1. After a predetermined length of time since the start of applying the second grid-voltage Vg2, at t4, the controller 100 switches the developer-voltage Vb to be applied to the developer roller 71 from the first developer-voltage Vb1 to the second developer-voltage Vb2, which is higher than the first developer-voltage Vb1. The timing 14 is a moment when the surface of the photosensitive drum 61 that was charged at t3 should reach the position to contact the developer roller 71.

After a predetermined length of time from t4, at t5, the controller 100 applies a negative transfer-voltage to the transfer roller 63, and after a predetermined length of time from t5, at t6, the controller 100 switches the neutralizing lamp 90 on. The timing t5 is a moment when the electrostatic latent image on the surface of the photosensitive drum 61 that was developed at 14 should reach the position to contact the transfer roller 63. The timing 16 is a moment when the surface of the photosensitive drum 61 that contacted the transfer roller 63 should reach the position to face with the neutralizing lamp 90. After a predetermined length of time from completion of limning the image, at t7, the controller 100 switches the grid-voltage Vg to be applied to the grid electrode 62B from the second grid-voltage Vg2 to the first grid-voltage Vg1.

After t7, at t8, the controller 100 switches the electromagnetic clutch 223 off and stops the power supply to the motor 210. Thereafter, the motor 210, the photosensitive drum 61 and the developer roller 71 may continue to rotate by inertia, and the velocity-reduction controlling process, in which the rotating velocity of the motor 210 and the peripheral velocity of the photosensitive drum 61 and the developer roller 71 are reduced to stop, starts.

As the velocity-reduction controlling process starts at 18, the controller 100 changes the developer-voltage Vb to be applied to the developer roller 71 according to the humidity. For example, when the humidity is determined to be low, the controller 100 may switch the developer-voltage Vb from the second developer-voltage Vb2 to the first developer-voltage Vb1, which is lower than the second developer-voltage Vb1, as indicated by a broken line in FIG. 8. On the other hand, when the humidity is determined to be high, the controller 100 may switch the developer-voltage Vb from the second developer-voltage Vb2 to the third developer-voltage Vb3, which is higher than the second developer-voltage Vb2, as indicated by a solid line in FIG. 8.

Further, at t8, the controller 100 switches the transfer-voltage off and switches the cleaner-voltage from the second cleaner-voltage Vs2 to the first cleaner-voltage Vs1. Thereafter, at t9, the controller 100 switches the neutralizing lamp 90 off.

After t9, when the rotating velocity of the photosensitive drum 61 is reduced to be lower than a predetermined velocity, at t10, the controller 100 switches the grid-voltage Vb, the developer-voltage Vb, and the cleaner-voltage off.

According to the control of the voltages by the controller 100 described above, during the preparatory rotation controlling process under the condition of the high humidity, the developer roller 71 is rotated at the second roller peripheral velocity V2, i.e., the high velocity. Therefore, the toner may be restrained from losing the charge, which was frictionally charged in the area upstream from the intermediate nipping position between the developer roller 71 and the photosensitive drum 61, while the toner is carried on the developer roller 71 to reach the nipping position. Accordingly, adherence of the toner to the unexposed areas in the photosensitive drum 61 may be restrained during the preparatory rotation controlling process under the condition of high humidity. Meanwhile, during the preparatory rotation controlling process under the condition of the low humidity, the developer roller 71 may be rotated at the first roller peripheral velocity V1, i.e., the low velocity, deterioration of the toner, which may be likely to occur as the rotating amount of the developer roller 71 increases, may be restrained.

According to the control of the voltages by the controller 100 described above, while adherence of the toner to the unexposed areas in the photosensitive drum 61 may be restrained during the preparatory rotation controlling process, waste of the toner may be reduced, and an amount of the toner to be stored in the residue container 64E in the cleaning unit 64 may be reduced. Therefore, duration of life of the cleaning unit 64 may be extended.

According to the control of the voltages by the controller 100 described above, the grid-voltage Vb and the developer-voltage Vb during the preparatory rotation controlling process may be controlled to be lower than those during the image-forming controlling process; therefore, power consumption in total may be restrained.

According to the control of the voltages by the controller 100 described above, the developer roller 71, the supplier roller 72, and the agitator 75 are rotated synchronously at the predetermined peripheral velocity ratio. Therefore, during the preparatory rotation controlling process under the condition of the high humidity, the supplier roller 72 and the agitator 75 may be rotated at the high velocities along with the rotation of the developer roller 71. Accordingly, the toner may be effectively stirred and charged by the agitator 75 rotated in the high velocity and may further be charged frictionally between the developer roller 71 and the supplier roller 72 effectively.

According to the control of the voltages by the controller 100 described above, during the velocity-reduction controlling process under the condition of the high humidity, the third developer-voltage Vb3, which is higher than the developer-voltage Vb during the image-forming controlling process, is applied to the developer roller 71 so that the electric potential difference between the photosensitive drum 61 and the developer roller 71 may be reduced, and adherence of the toner to the unexposed area in the photosensitive drum 61, which may be caused by the reduced chargeable amount in the toner under the condition of the high humidity, may be restrained. Meanwhile, during the velocity-reduction controlling process under the condition of the low humidity, the developer-voltage Vb1, which is lower than the developer-voltage Vb3 during the velocity-reduction controlling process under the condition of the high humidity, is applied to the developer roller 71. Therefore, adherence of the toner to the unexposed areas in the photosensitive drum 61, which may occur when the voltage difference between the grid-voltage Vg and the developer-voltage Vb is reduced under the condition of the low humidity, may be restrained.

According to the control of the voltages by the controller 100 described above, during the first voltage controlling process, the first grid-voltage Vg1, which is lower than the grid-voltage Vg during the image-forming controlling process, is applied to the grid electrode 62B. Therefore, the voltage difference between the grid-voltage Vg and the developer-voltage Vb during the first voltage controlling process may be reduced, and adherence of the toner to the unexposed areas in the photosensitive drum 61 may be effectively restrained.

It is recognized that, if the grid-voltage Vg is applied to the grid electrode 62B while the rotating velocity of the photosensitive drum 61 is lowered, the surface potential of the photosensitive drum 61 may increase to be excessively high. In this regard, according to the control of the voltages by the controller 100 described above, when the rotating velocity of the photosensitive drum 61 is reduced to the predetermined velocity or lower, application of the grid-voltage Vg to the grid electrode 62B is stopped. Therefore, increase of the surface potential of the photosensitive drum 61 may be restrained.

Although an example of carrying out the invention has been described, those skilled in the art will appreciate that there are numerous variations and permutations of the image forming apparatus and the controlling method that fall within the spirit and scope of the invention as set forth in the appended claims. For example, the flows of control and the voltage control shown in FIGS. 6-8 may be modified into those described below and shown in FIGS. 9-11. In the following description, items, structures, and steps in the flows, which are identical or equivalent to those described in the previous embodiment may be referred to by the same reference signs, and explanation of those will be omitted.

In the previous embodiment, during the preparatory rotation controlling process under the condition of the high humidity, the developer roller 71 is rotated to the second roller peripheral velocity V2 by switching the electromagnetic clutch 223 on; however, the developer roller 71 may be rotated to the second roller peripheral velocity V2 without switching the electromagnetic clutch 223 on. For example, while the electromagnetic clutch 223 is maintained off, the rotating velocity of the motor 210 may be switched from the low velocity to the high velocity. More specifically, the controller 100 may conduct a flow of steps shown in FIG. 9.

Figure 9:
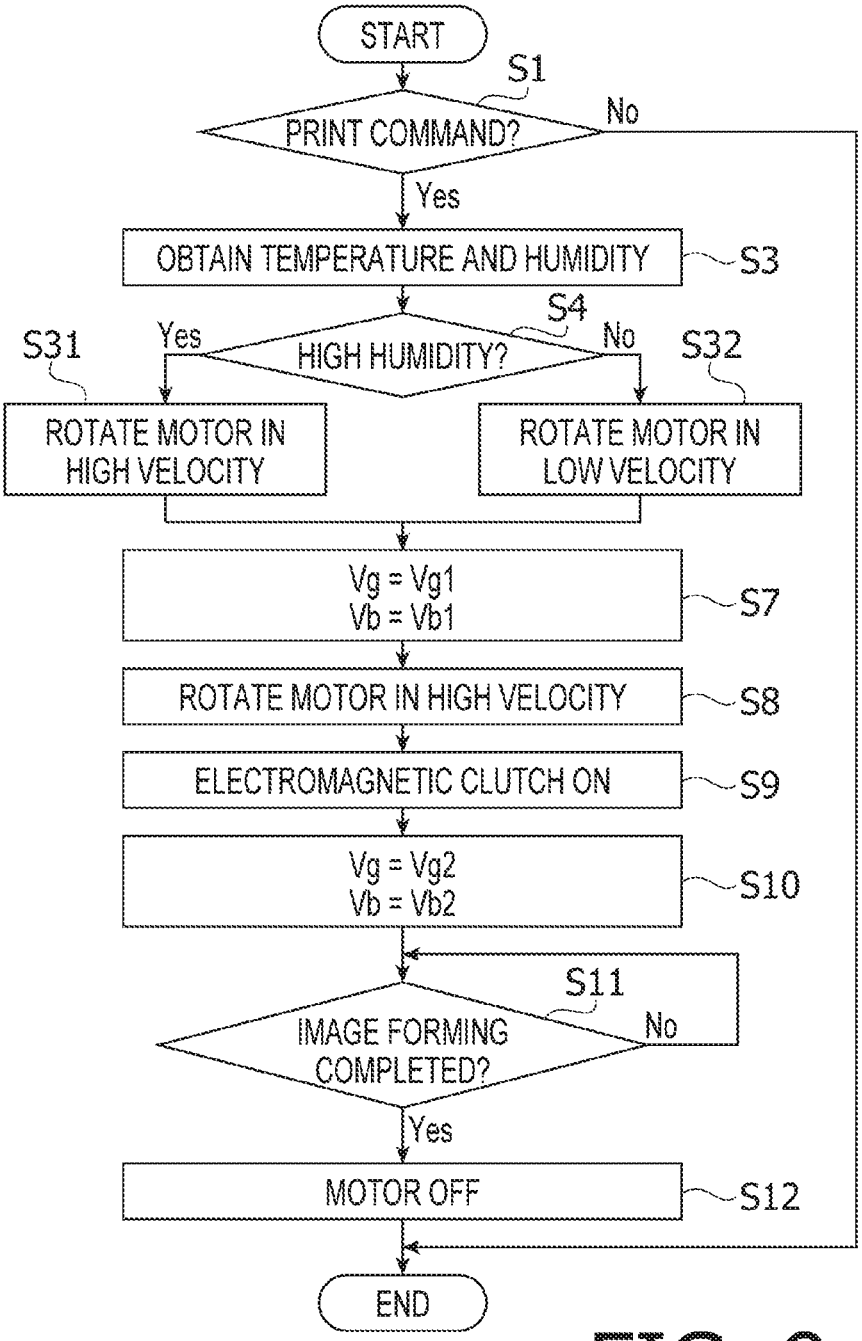
FIG. 9 is a flowchart to illustrate another flow of steps in the preparatory rotation controlling process to be conducted by the controller in the laser printer according to the exemplary embodiment of the present disclosure.

The flowchart shown in FIG. 9 may include steps similar to those in FIG. 6, but S2 eluded in FIG. 6 is omitted, and S5 and S6 included in FIG. 6 are replaced with S31 and S32, respectively. In S31, the controller 100 supplies a second current A2, which is greater than the first current A1, to the motor 210 so that the motor 210 is rotated at the high velocity. Meanwhile, the electromagnetic clutch 233 is switched off. Thereby, the photosensitive drum 61 may be rotated at the second drum peripheral velocity which is higher than the first drum peripheral velocity, and the developer roller 71 may be rotated at the second roller peripheral velocity V2, which is higher than the first roller peripheral velocity V1.

On the other hand, in S32, the controller 100 supplies the first current A1 to the motor 210 to rotate the motor 210 at the tow velocity. Meanwhile, the electromagnetic clutch 233 is switched off. Thereby, the photosensitive drum 61 may be rotated at the first drum peripheral velocity; which is lower than the second drum peripheral velocity, and the developer roller 71 may be rotated at the first roller peripheral velocity V1.

Figure 7:
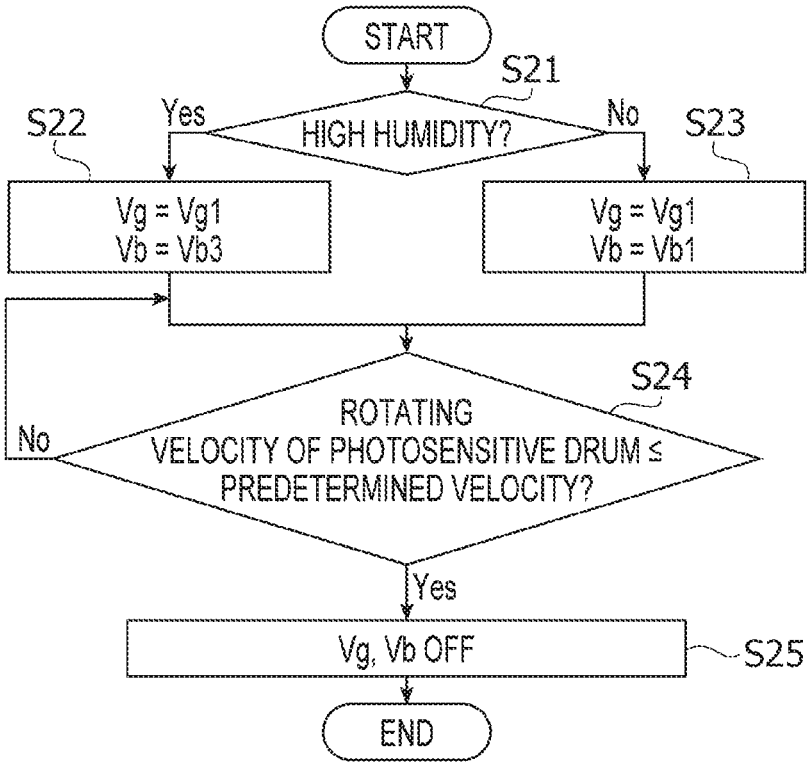
FIG. 7 is a flowchart to illustrate a voltage controlling process in a velocity-reduction controlling process to be conducted by the controller in the laser printer according to the exemplary embodiment of the present disclosure.

In the previous embodiment, as shown in FIGS. 7 and 8, the developer-voltage Vb is shifted from the second developer-voltage Vb2 to the third developer-voltage V3 instantly in the first voltage controlling process; however, the developer-voltage Vb may be increased gradually. For example, the developer-voltage Vb may be increased from the second developer-voltage Vb2 to the third developer-voltage Vb3 gradually in accordance with reduction of the rotating velocity of the developer roller 71. Specifically, the controller 100 may conduct a flow shown in FIG. 10.

Figure 10:
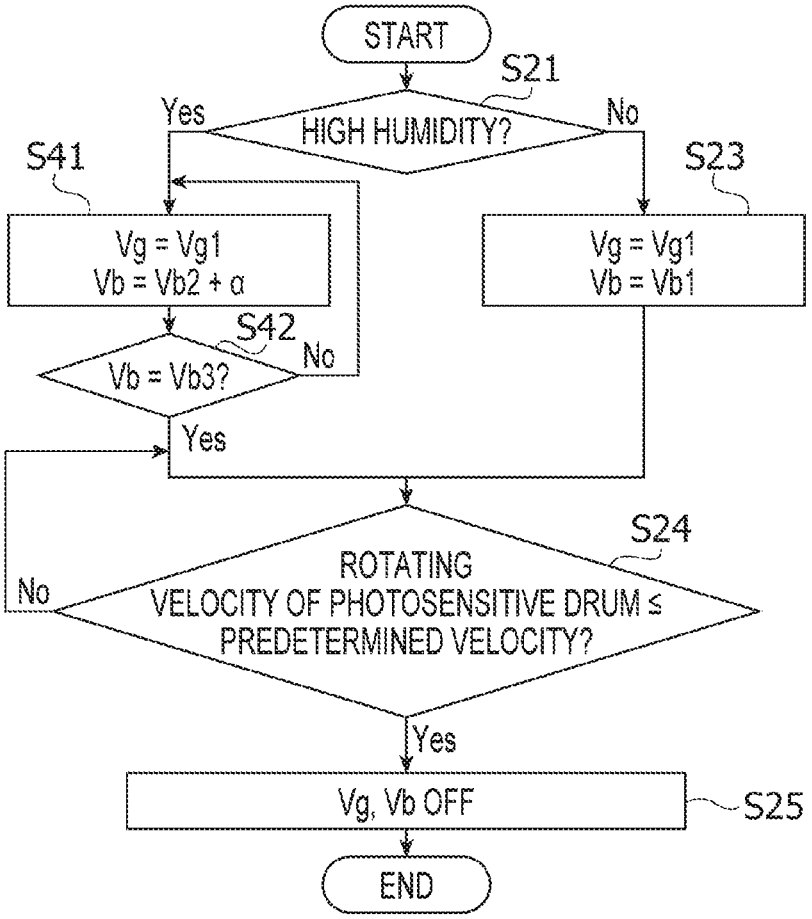
FIG. 10 is a flowchart to illustrate a flow of steps in a first voltage controlling process to be conducted by the controller in the laser printer according to the exemplary embodiment of the present disclosure.

The flowchart shown in FIG. 10 may include steps similar to those in FIG. 7, but S22 included in FIG. 7 is omitted, and S41 and S42 are added. In S41, the controller 100 applies the first grid-voltage Vb1 to the grid electrode 62B and modifies the value of the developer-voltage Vb to be applied to the developer roller 71 to a value, which is the second developer-voltage Vb2 plus a predetermined amount $\alpha$. The predetermined amount $\alpha$ is a value, which may be increased to be larger each time S41 is repeated as long as the value Vb2+$\alpha$ is lower than or equal to the value of the third developer voltage Vb3.

Following S41, in S42, the controller 100 determines whether the developer-voltage Vb is currently equal to the third developer-voltage Vb3. If the controller 100 determines that the developer-voltage Vb is not equal to the third developer voltage Vb3 (S42: NO), the controller 100 returns to S41. Thus, the flow of S41-S42 is repeated at a predetermined interval while the developer-voltage Vb is increased from the second developer-voltage Vb2 to the third developer-voltage Vb3 gradually if the controller 100 determines that the developer-voltage Vb is at the third developer-voltage Vb3 (S42: YES), the flow proceeds to S24.

Figure 11:
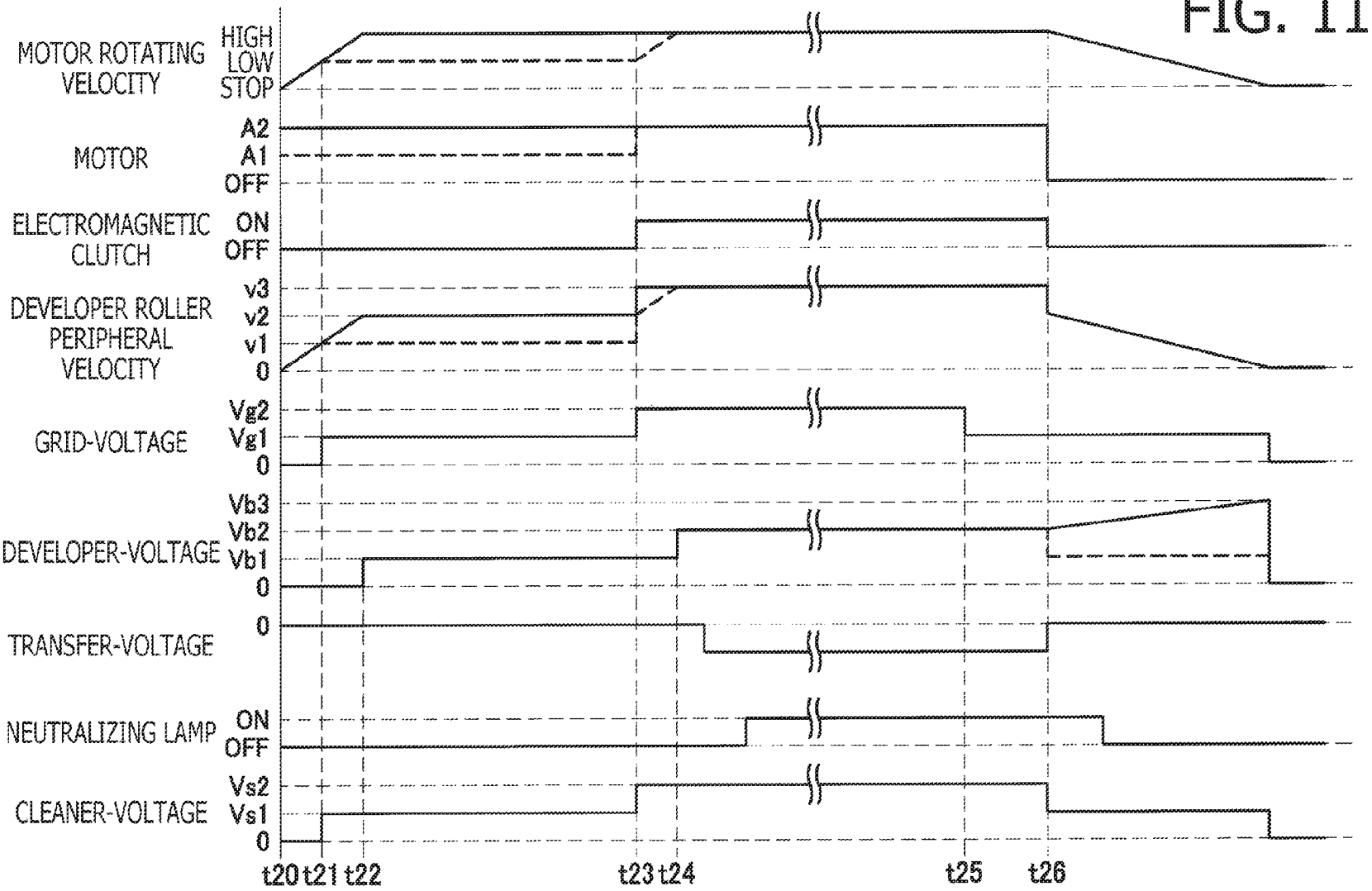
FIG. 11 is a time chart to illustrate behaviors of the controller during the controlling flows shown in FIGS. 9 and 10 in the laser printer according to the exemplary embodiment of the present disclosure.

FIG. 11 is a time chart to illustrate chronological behaviors of the controller 100 according to the flows of steps shown in FIGS. 9 and 10. In the following description, explanation of control of the transfer-voltage, the neutralizing lamp, and the cleaner-voltage, which may be similar to those shown in in FIG. 8, is omitted.

When the controller receives the print command at t20, as shown in FIG. 11, the controller 100 determines the condition of the humidity, and if the humidity is not high but low, as indicated by a broken line in FIG. 11, the controller 100 supplies the first current A1 to the motor 210 to rotate the motor 210 at the low velocity. Accordingly, the developer roller 71 is rotated at the first roller peripheral velocity V1.

On the other hand, when the humidity is determined to be high, the controller 100 supplies the second current A2 to the motor 210 to rotate the motor 210 at the high velocity, as indicated by a solid line in FIG. 11. Accordingly, the developer roller 71 is rotated at the second roller peripheral velocity V2.

Meanwhile, during the preparatory rotation controlling process, which is conducted prior to the image-forming controlling process, the electromagnetic clutch 223 is maintained off. Thereby, the peripheral velocity ratio of the developer roller 71 with respect to the photosensitive drum 61 is maintained to be lower than 1. In other words, the peripheral velocity of the developer roller 71 is maintained to be lower than the peripheral velocity of the photosensitive drum 61.

Thereafter, similarly to the previous embodiment described above, after starting rotating the motor 210, at t21, the controller 100 applies the first grid-voltage Vg1 to the grid electrode 62B, and at t22, the controller 100 applies the first developer-voltage Vb1 to the developer roller 71. After completion of the preparatory rotation controlling process, at t23, the controller 100 switches the electromagnetic clutch 223 on to start the image-forming controlling process. Thereby, the peripheral velocity of the developer roller 71 is switched from either the first roller peripheral velocity V1 or the second roller peripheral velocity V2 to the third roller peripheral velocity V3. Further, with the electromagnetic clutch 223 being switched on, the peripheral velocity ratio of the developer roller 71 with respect to the photosensitive drum 61 is switched to 1 or higher. In other words, the peripheral velocity of the developer roller 71 is shifted to be higher than the peripheral velocity of the photosensitive drum 61. Further at t23, the controller 100 switches the grid-voltage Vg to be applied to the grid electrode 62B from the first grid-voltage Vg1 to the second grid-voltage Vg2.

After a predetermined length of time, at t24, the controller 100 switches the developer-voltage Vb from the first developer-voltage Vb1 to the second developer-voltage Vb2. After a predetermined length of time from completion of forming the image, at t25, the controller 100 switches the grid-voltage Vg from the second grid-voltage Vg2 to the first grid-voltage Vg1.

After t25, at t26, the controller 100 switches the electromagnetic clutch 223 off and stops the power supply to the motor 210. Thereafter, the motor 210, the photosensitive drum 61, and the developer roller 71 may continue to rotate by inertia, and the velocity-reduction controlling process, in which the rotating velocity of the motor 210 and the peripheral velocity of the photosensitive drum 61 and the developer roller 71 are reduced to stop, starts.

As the velocity-reduction controlling process starts at t26, the controller 100 changes the developer-voltage Vb to be applied to the developer roller 71 according to the humidity. For example, when the humidity is determined to be low, the controller 100 may lower the developer-voltage Vb from the second developer-voltage Vb2 to the first developer-voltage Vb1, as indicated by a broken line in FIG. 11. On the other hand, when the humidity is determined to be high, the controller 100 may increase the developer-voltage Vb gradually from the second developer-voltage Vb2 to the third developer-voltage Vb3, as indicated by a solid line in FIG. 8.

According to the control of the voltages by the controller 100 described above, as illustrated in FIGS. 9-11, when the developer roller 71 is rotated at the first roller peripheral velocity V1, i.e., the low velocity, the photosensitive drum 61 is rotated at the first drum peripheral velocity, i.e., the low velocity. On the other hand, when the developer roller 71 is rotated at the second roller peripheral velocity V2, i.e., the high velocity, the photosensitive drum 61 is rotated at the second drum peripheral velocity, i.e., the high velocity. In other words, the electromagnetic clutch 223 is maintained off during the preparatory rotation controlling process; therefore, under the condition of either the high humidity or the low humidity, the peripheral velocity ratio of the developer roller 71 with respect to the photosensitive drum 61 may be maintained constant. In this regard, if the peripheral velocity ratio is set at a value, in which the toner may be less likely to adhere to the unexposed areas in the photosensitive drum 61, adherence of the toner to the unexposed areas in the photosensitive drum 61 may be restrained.

According to the control of the voltages by the controller 100 described above, during the preparatory rotation controlling process, the peripheral velocity of the developer roller 71 is reduced to be lower than the peripheral velocity of the photosensitive drum 61. Therefore, an amount of the toner to be supplied from the developer roller 71 to the photosensitive drum 61 may be reduced, and adherence of the toner to the unexposed areas in the photosensitive drum 61 may be preferably restrained.

It may be recognized that, as the rotating velocity of the developer roller 71 is lowered, the chargeable amount of the toner on the developer roller 71 may be lowered, and the toner may be more likely to adhere to the unexposed areas in the photosensitive drum 61. Meanwhile, according to the control of the voltages by the controller 100 described above, as shown in FIGS. 9-11, the developer-voltage Vb is increased gradually according to the reduction of the rotating velocity of the developer roller 71. Therefore, the potential difference between the grid-voltage Vg and the developer-voltage Vb may be lowered gradually, and adherence of the toner to the unexposed areas in the photosensitive drum 61 may be preferably restrained.

Although examples of carrying out the invention have been described, those skilled in the art will appreciate that there are numerous variations and permutations of the image forming apparatus and the controlling method that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiment may merely be regarded as examples of the claimed subject matters.

For example, the developer-voltage Vb under the condition of the low humidity during the velocity-reduction controlling process, i.e., the first developer-voltage Vb1, may not necessarily be lower than the developer-voltage Vb during the image-forming controlling process but may be any voltage as long as it is lower than the developer-voltage Vb during the velocity-reduction controlling process under the condition of the high humidity. In other words, the developer-voltage Vb under the condition of the low humidity during the velocity-reduction controlling process may be higher than the developer-voltage during the image-forming controlling process, i.e., higher than the second developer-voltage V2.

For another example, the photosensitive drum 61 may be replaced with a photosensitive belt.

For another example, the charger 62 may not necessarily have the scorotoron-typed charger but may have a corotron-typed charger or a charger roller that may contact the photosensitive member.

For another example, the present disclosure may not necessarily be applied to a laser printer such as the laser printer 1 described above but may be applied to, for example, a copier and a multifunction peripheral.

For another example, the developer agent may not necessarily be limited to the positively chargeable toner but may include a negatively-chargeable toner. When the negatively-chargeable toner is employed, the polarity of the grid-voltage and the developer-voltage may be inverted to negative to comply with the negatively-chargeable toner, but absolute values of the grid-voltage and the developer-voltage may be maintained the same as those in the grid-voltage and the developer-voltage of the above-described embodiment.

What is claimed is:

1. An image forming apparatus, comprising:

a photosensitive member;

an exposure device configured to expose the photosensitive member and form an electrostatic latent image on the photosensitive member;

a developer roller configured to contact the photosensitive ember and supply a developer agent to the photosensitive member;

a humidity sensor configured to detect humidity; and a controller configured to execute a preparatory rotation controlling process, in which the photosensitive member and the developer roller are rotated prior to forming the electrostatic latent image on the photosensitive member; and an image-forming controlling process, in which the electrostatic latent image is formed on the photosensitive member, wherein, in the preparatory rotation controlling process, the controller controls the developer roller to rotate at a first peripheral velocity under a condition of the humidity being lower than or equal to a predetermined value, and the controller controls the developer roller to rotate at a second peripheral velocity being higher than the first peripheral velocity under a condition of the humidity being higher than the predetermined value.

2. The image forming apparatus according to claim 1, further comprising a charger configured to charge the photosensitive member, wherein, in the preparatory rotation controlling process, the controller applies a first charger-voltage to the charger and a first developer-voltage to the developer roller, and wherein, in the image-forming controlling process, the controller applies a second charger-voltage being higher than the first charger-voltage to the charger and a second developer-voltage being higher than the first developer-voltage to the developer roller.

3. The image forming apparatus according to claim 2, wherein, in the preparatory rotation controlling process, the controller controls the photosensitive member to rotate at a third peripheral velocity under a condition of the developer roller being rotated at the first peripheral velocity, and controls the photosensitive member to rotate at a fourth peripheral velocity being higher than the third peripheral velocity under a condition of the developer roller being rotated at the second peripheral velocity.

4. The image forming apparatus according to claim 1, wherein, in the preparatory rotation controlling process, the controller controls a peripheral velocity of the developer roller to be lower than a peripheral velocity of the photosensitive member, and wherein, in the image-forming controlling process, the controller controls the peripheral velocity of the developer roller to be higher than the peripheral velocity of the photosensitive member.

5. The image forming apparatus according to claim 1, further comprising a supplier roller configured to contact the developer roller and supply the developer agent to the developer roller, the supplier roller being configured to rotate at a predetermined peripheral velocity ratio with respect to the developer roller.

6. The image forming apparatus according to claim 1, further comprising:

a container configured to contain the developer agent; and an agitator configured to rotate in the container and convey the developer agent in the container toward the developer roller by rotating, the agitator being configured to rotate at a predetermined peripheral velocity ratio with respect to the developer roller.

7. An image forming apparatus, comprising:

a photosensitive member;

an exposure device configured to expose the photosensitive member and form an electrostatic latent image on the photosensitive member;

a developer roller configured to contact the photosensitive member and supply a developer agent to the photosensitive member;

a humidity sensor configured to detect humidity;

a temperature sensor configured to detect temperature; and a controller configured to execute a preparatory rotation controlling process, in which the photosensitive member and the developer roller are rotated prior to forming the electrostatic latent image on the photosensitive member; and an image-forming controlling process, in which the electrostatic latent image is formed on the photosensitive member, wherein in the preparatory rotation controlling process, the controller controls the developer roller to rotate at a first peripheral velocity under a condition of the humidity at a predetermined value of temperature being lower than or equal to a predetermined value of humidity, and the controller controls the developer roller to rotate at a second peripheral velocity being higher than the first peripheral velocity under a condition of the humidity at the predetermined value of temperature being higher than the predetermined value of humidity.

8. The image forming apparatus according to claim 7, further comprising a charger configured to charge the photosensitive member, wherein, in the preparatory rotation controlling process, the controller applies a first charger-voltage to the charger and a first developer-voltage to the developer roller, and wherein, in the image-forming controlling process, the controller applies a second charger-voltage being higher than the first charger-voltage to the charger and a second developer-voltage being higher than the first developer-voltage to the developer roller.

9. The image form ing apparatus according to claim 8, wherein, in the preparatory rotation controlling process, the controller controls the photosensitive member to rotate at a third peripheral velocity under a condition of the developer roller being rotated at the first peripheral velocity, and controls the photosensitive member to rotate at a fourth peripheral velocity being higher than the third peripheral velocity under a condition of the developer roller being rotated at the second peripheral velocity.

10. The image forming apparatus according to claim 7, wherein, in the preparatory rotation controlling process, the controller controls peripheral velocity of the developer roller to be lower than a peripheral velocity of the photosensitive member, and wherein, in the image-forming controlling process, the controller controls the peripheral velocity of the developer roller to be higher than the peripheral velocity of the photosensitive member.

11. The image forming apparatus according to claim 7, further comprising a supplier roller configured to contact the developer roller and supply the developer agent to the developer roller, the supplier roller being configured to rotate at a predetermined peripheral velocity ratio with respect to the developer roller.

12. The image forming apparatus according to claim 7, further comprising:

a container configured to contain the developer agent; and an agitator configured to rotate in the container and convey the developer agent in the container toward the developer roller by rotating, the agitator being configured to rotate at a predetermined peripheral velocity ratio with respect to the developer roller.

13. A method to control an image forming apparatus, the image forming apparatus comprising a photosensitive member, an exposure device configured to expose the photosensitive member and form an electrostatic latent image on the photosensitive member, and a developer roller configured to contact the photosensitive member and supply a developer agent to the photosensitive member, the method comprising:

controlling preparatory rotation of the photosensitive member and the developer roller, in which the photosensitive member and the developer roller are controlled to rotate prior to forming the electrostatic latent image on the photosensitive member; and controlling image-forming, in which the electrostatic latent image is formed on the photosensitive member, wherein, during the control of the preparatory rotation, the developer roller is controlled to rotate at a first peripheral velocity under a condition of the humidity being lower than or equal to a predetermined value, and the developer roller is controlled to be rotated at a second peripheral velocity being higher than the first peripheral velocity under a condition of the humidity being higher than the predetermined value.

14. The method according to claim 13, wherein, during the control of the preparatory rotation, a first charger-voltage is applied to a charger being configured to charge the photosensitive member, and a first developer-voltage is applied to the developer roller, and wherein, during the control of the image-forming, the controller applies a second charger-voltage being higher than the first charger-voltage to the charger and a second developer-voltage being higher than the first developer-voltage to the developer roller.

15. The method according to claim 14, wherein, during the control of the preparatory rotation, the photosensitive member is controlled to rotate at a third peripheral velocity under a condition of the developer roller being rotated at the first peripheral velocity, and the photosensitive member is controlled to rotate at a fourth peripheral velocity being higher than the third peripheral velocity under a condition of the developer roller being rotated at the second peripheral velocity.

16. The method according to claim 13, wherein, during the control of the preparatory rotation, a peripheral velocity of the developer roller is controlled to be lower than a peripheral velocity of the photosensitive member, and wherein, during the control of the image-forming the peripheral velocity of the developer roller is controlled to be higher than the peripheral velocity of the photosensitive member.

17. The method according to claim 13, wherein a supplier roller configured to contact the developer roller and supply the developer agent to the developer roller is controlled to rotate at a predetermined peripheral velocity ratio with respect to the developer roller.

18. The method according to claim 13, wherein an agitator configured to rotate in a developer agent container and convey the developer agent in the developer agent container toward the developer roller is rotated at a predetermined peripheral velocity ratio with respect to the developer roller.

* * * * *